US011772692B2

(12) United States Patent
Kernwein

(10) Patent No.: US 11,772,692 B2
(45) Date of Patent: Oct. 3, 2023

(54) METHOD AND APPARATUS FOR VEHICLE-BASED SWITCH LOCKING IN A RAIL NETWORK

(71) Applicant: Westinghouse Air Brake Technologies Corporation, Wilmerding, PA (US)

(72) Inventor: Jeffrey D. Kernwein, Cedar Rapids, IA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 1058 days.

(21) Appl. No.: 16/206,674

(22) Filed: Nov. 30, 2018

(65) Prior Publication Data

US 2020/0172131 A1 Jun. 4, 2020

(51) Int. Cl.
*B61L 7/06* (2006.01)
*B61L 5/10* (2006.01)

(52) U.S. Cl.
CPC ..... *B61L 7/06* (2013.01); *B61L 5/102* (2013.01)

(58) Field of Classification Search
CPC ..... B61L 7/06; B61L 5/102
See application file for complete search history.

(56) References Cited

U.S. PATENT DOCUMENTS 9,669,853 B2 * 6/2017 Kurita ..... B61L 27/0038
2007/0040068 A1 * 2/2007 Bartonek ..... B61K 9/08 246/120
2007/0247773 A1 * 10/2007 Bartonek ..... H02H 1/06 361/91.1
2014/0209758 A1 * 7/2014 Kurita ..... B61L 27/0038 246/2 S
2016/0257325 A1 * 9/2016 Kernwein ..... B61L 11/08
2018/0327010 A1 * 11/2018 Kernwein ..... B61L 1/14
2020/0017131 A1 * 1/2020 Houghton ..... B61L 27/0005

FOREIGN PATENT DOCUMENTS

EP 1752355 A2 2/2007
EP 2860082 A1 4/2015
JP 2002059832 A 2/2002
WO 2013092113 A1 6/2013

OTHER PUBLICATIONS

International Search Report and Written Opinion, International Application No. PCT/US2019/029782, dated Aug. 29, 2019, (11) pages.
International Preliminary Report on Patentability dated Jun. 10, 2021 for corresponding application No. PCT/US2019/029782 (8 pages).

* cited by examiner

*Primary Examiner* — Ramsey Refai
(74) *Attorney, Agent, or Firm* — The Small Patent Law Group LLC; Christopher R. Carroll

(57) ABSTRACT

A switch locking system and method of an authorized locomotive for safely traversing a switch in a railway including sending a lock command from a computer onboard the authorized locomotive to a switch controller associated with the switch; determining if a lock confirmation from the switch controller is received by the computer onboard the authorized locomotive; and safely traversing the switch upon receipt of the lock confirmation. The switch locking system and method may include sending an unlock command from a computer onboard the authorized locomotive to a switch controller after the train clears the switch.

20 Claims, 5 Drawing Sheets

METHOD AND APPARATUS FOR VEHICLE-BASED SWITCH LOCKING IN A RAIL NETWORK

BACKGROUND

Field of the Invention

The present invention relates to switch locking systems and methods of an authorized locomotive for safely traversing a switch in a railway, and, in particular, safety methods of locking a switch to simplify railway switch control.

Description of Related Art

There is a growing movement to transport more material by rail as production of goods reaches capacity. Additional and improved safety systems are also required to solve problems in current track switching systems. Thus, there are efforts to improve the safety and efficiency of switching systems used to traverse a railway. Automated switches extend a railway based on the positioning (e.g., orienting to a position, aligning, configuring, etc.) of a switch performed by a dispatcher (e.g., a central system, a dispatch system, etc.) to automatically route a train to a mainline track or route the train into a siding. Switches are positioned along the railway providing a train access to a siding into another line and/or to remain on the main line.

However, installing a switch in a track network may introduce hazards that must be properly mitigated for safe train movement. For example, a hazard involving automated switches may occur when the train is positioned over a switch as a dispatcher changes its position, causing derailment or worse as a train moves through the switch. A hazard may also occur when a switch changes position as it traverses an approach to a switch, causing a hazard resulting in derailment, entering an unauthorized and possibly occupied area of track network, or only moving halfway between either switch positions, and leaving a train without the capability to continue to traverse the switch in either direction.

In switching systems, the conditions for locking a switch may be established by equipment located in the railway, such as, for example, track circuits to detect a locomotive in an area of track on approach to a switch. In a track circuit, a system monitors occupancy based on a train traversing the electrical circuit (e.g., a track circuit just before a switch, a track circuit just after a switch, etc.) that must be sufficiently long enough to ensure that the switch cannot move in advance of the train. However, these long track circuits may decrease rail operations associated with a long approach circuit and limit movements to a fixed length of approach and/or number of blocks. In addition, in some cases track circuits may be a half a mile or longer, greatly increasing the expense to install, replace, update, and/or constantly maintain such devices.

SUMMARY

In some non-limiting embodiments or aspects, provided are remote switch locking systems and methods for controlling a switch from a locomotive, computer-implemented switch locking methods, and computer program products for a train. Preferably, provided are improved systems, methods, and computer program products that overcome certain deficiencies and drawbacks associated with existing switch dispatching systems, methods, and computer program products.

In one non-limiting embodiment or aspect, provided is a computer-implemented switch locking method for safely traversing a switch in a railway by an authorized locomotive. The method may include: sending a lock command from a computer onboard the authorized locomotive to a switch controller associated with the switch; determining if a lock confirmation from the switch controller is received by the computer onboard the authorized locomotive; and safely traversing the switch upon receipt of the lock confirmation.

In another non-limiting embodiment or aspect, provided is a method of locking a switch by a self-dispatching locomotive. The method may include, authorizing the self-dispatching locomotive, from a central dispatcher, to traverse a segment of a railway including at least one switch located on the railway; issuing a lock command by the self-dispatching locomotive, the lock command issued to a switch controller associated with the at least one switch to lock the at least one switch; and activating the switch by the switch controller to lock out one or more switch control requests.

In a non-limiting embodiment or aspect, provided is a system for controlling movement of a train in a track network. The system may include a switch associated with a segment of the railway and a switch controller, the switch controller coupled to the switch, and an authorized locomotive including an on-board computer, the authorized locomotive having authority to traverse the switch. The on-board computer system is configured to send a lock command from a computer onboard the authorized locomotive to a switch controller associated with the switch; determine if a lock confirmation from the switch controller is received by the computer onboard the authorized locomotive; and safely traverse the switch upon receipt of the lock confirmation.

In another non-limiting embodiment or aspect, provided is a computer program product comprising at least one non-transitory computer-readable medium including program instructions that, when executed by at least one computer including at least one processor, causes the at least one computer to: send a lock command from a computer onboard the authorized locomotive to a switch controller associated with the switch; determine if a lock confirmation from the switch controller is received by the computer onboard the authorized locomotive; and safely traverse the switch upon receipt of the lock confirmation.

The present invention is neither limited to nor defined by the above summary. Rather, reference should be made to the claims for which protection is sought with consideration of equivalents thereto.

Further non-limiting embodiments or aspects will now be described in the following numbered clauses:

Clause 1: A switch locking method of an authorized locomotive for safely traversing a switch in a railway, the method comprising: sending a lock command from a computer onboard the authorized locomotive to a switch controller associated with the switch; determining if a lock confirmation from the switch controller is received by the computer onboard the authorized locomotive; and safely traversing the switch upon receipt of the lock confirmation.

Clause 2: The method according to clause 1, comprising: preventing the authorized locomotive from traversing the switch if the lock confirmation from the switch controller is not received by the computer onboard the authorized locomotive.

Clause 3: The method according to clauses 1 and 2, further comprising preventing an external lock command from a switch dispatcher to influence a position of the switch until the authorized locomotive has unlocked the switch.

Clause 4: The method according to clauses 1-3, further comprising determining an acceptable switch alignment for the authorized locomotive to traverse a segment of the railway associated with a switch leg; issuing a switch command by the computer onboard the authorized locomotive, the switch command issued to the switch controller to align the switch to the acceptable switch alignment; and controlling the switch by the switch controller to align the switch in accordance with the switch command.

Clause 5: The method according to clauses 1-4, further comprising: transmitting the lock confirmation to the computer onboard the authorized locomotive or a dispatch computer, the lock confirmation including a switch status indicating the switch is locked.

Clause 6: The method according to clauses 1-5, further comprising: issuing an unlock command to the switch; and controlling the switch by the switch controller to release the switch from a locked status.

Clause 7: The method according to clauses 1-6, wherein sending the lock command further comprises: determining an address of the switch controller of the switch; and transmitting the lock command to the switch via the switch controller based on the address of the switch controller of the switch.

Clause 8: The method according to clauses 1-7, comprising: in response to receiving a request by at least one of a second locomotive or a central dispatcher to control the switch, generating a switch status indicating that the switch is locked to indicate a train is traversing a segment of the railway including the at least one portion of the switch; and transmitting the switch status to at least one of the second locomotive or the central dispatcher.

Clause 9: The method according to clauses 1-8, comprising: determining by the computer onboard the authorized locomotive, an approach by the authorized locomotive to a geographic location associated with the switch.

Clause 10: A method of locking a switch by a self-dispatching locomotive, the method comprising: authorizing the self-dispatching locomotive from a central dispatcher to traverse a segment of a railway including at least one switch located on the railway; issuing a lock command by the self-dispatching locomotive, the lock command issued to a switch controller associated with the at least one switch to lock the at least one switch; and activating the switch by the switch controller to lock out one or more switch control requests.

Clause 11: The method according to clause 10, comprising: determining if a lock confirmation from the switch controller is received by the self-dispatching locomotive; and preventing the self-dispatching locomotive from traversing the switch if the lock confirmation from the switch controller is not received by the self-dispatching locomotive.

Clause 12: The method according to clauses 10 and 11, comprising: preventing external commands from the central dispatcher to influence a position of the switch until the self-dispatching locomotive has unlocked the switch.

Clause 13: The method according to clauses 10-12, further comprising: determining an acceptable switch alignment of the switch, the acceptable switch alignment for the self-dispatching locomotive to traverse the segment of the railway associated with a switch leg; issuing a switch command by the self-dispatching locomotive to align the switch to the acceptable switch alignment; and controlling the switch by the switch controller to align the switch in accordance with the switch command.

Clause 14: The method according to clauses 10-13, further comprising: transmitting a lock confirmation by the switch controller including a switch status indicating the switch is locked.

Clause 15: The method according to clauses 10-14, further comprising: determining a clearance of the switch; and in response to determining the clearance of the switch, issuing an unlock command to the at least one switch to release the lock of the at least one switch.

Clause 16: The method according to clauses 10-15, wherein issuing the lock command by the self-dispatching locomotive, further comprises: determining an address for a switch controller of the at least one switch; and transmitting the lock command to the at least one switch based on the address for the at least one switch.

Clause 17: The method according to clauses 10-16, further comprising: in response to receiving a request by at least one of a second locomotive or the central dispatcher to control the switch before the lock command is issued by the self-dispatching locomotive: generating a switch status indicating that the switch is locked by a train in the segment of the railway including the at least one portion of the switch; and transmitting the switch status to the self-dispatching locomotive or the central dispatcher.

Clause 18: A system for controlling movement of a train in a track network, the system comprising: a switch associated with a segment of the railway, and a switch controller, the switch controller coupled to the switch; and an authorized locomotive including an on-board computer comprising one or more processors, the authorized locomotive having authority to traverse one or more switches, the on-board computer system configured to: send a lock command from a computer onboard the authorized locomotive to a switch controller associated with the switch; determine if a lock confirmation from the switch controller is received by the computer on board the authorized locomotive; and safely traverse the switch upon receipt of the lock confirmation; determine an acceptable switch alignment of at least one switch of the one or more switches to traverse a segment of the railway associated with a switch leg; issue a switch command to align the switch to the acceptable switch alignment; and send an unlock command to the switch controller associated with the locked switch, the unlock command configured to release the lock of the at least one switch.

Clause 19: The system according to clause 18, wherein the on-board computer system is further configured to: determine an acceptable switch alignment of at least one switch of the one or more switches to traverse a segment of the railway associated with a switch leg; and issue a switch command to align the switch to the acceptable switch alignment.

Clause 20: The system according to clauses 18 and 19, wherein the authorized locomotive is further configured to send an unlock command to the switch controller associated with the locked switch, the unlock command configured to release the lock of the at least one switch.

DESCRIPTION

Figure 1:
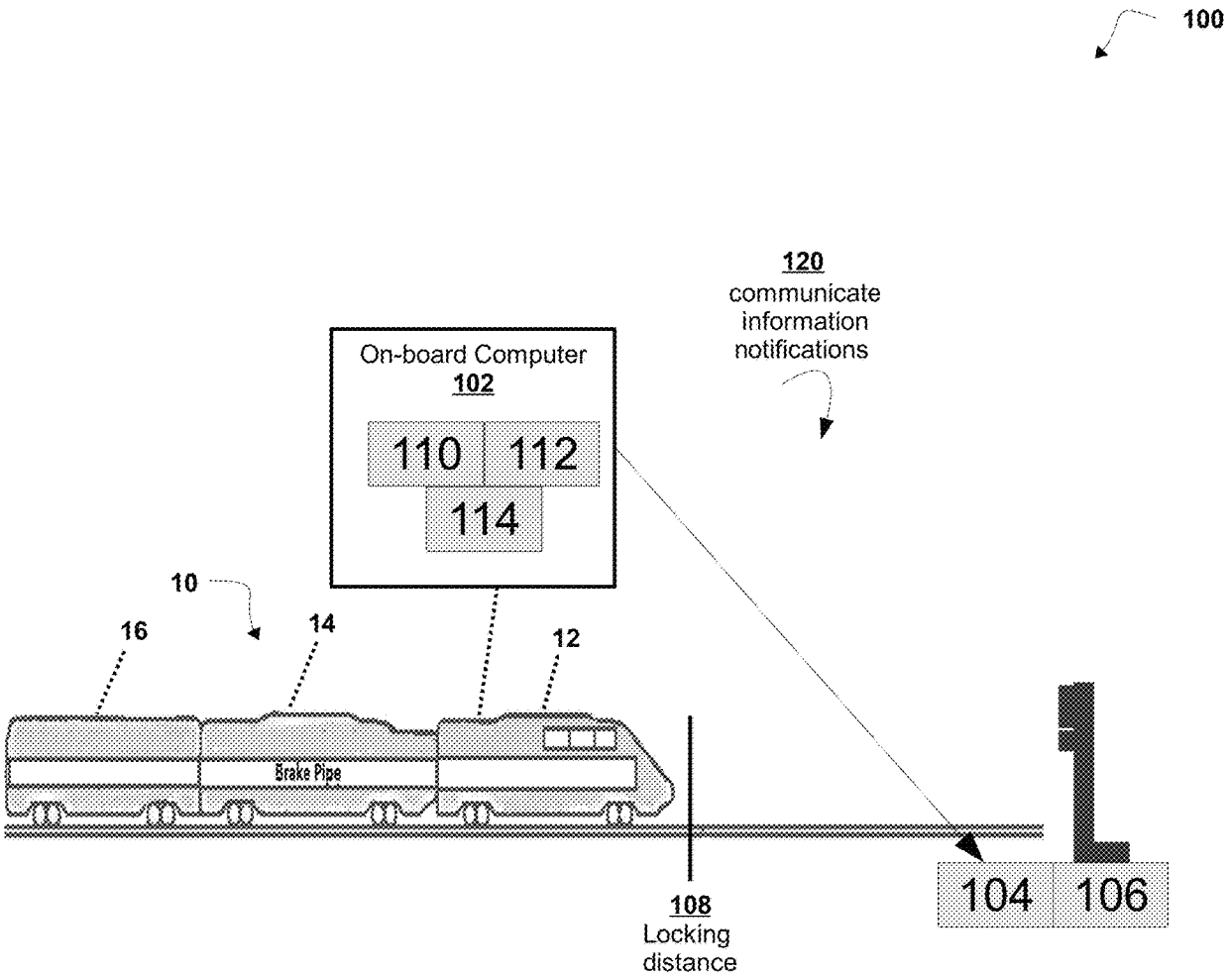
FIG. 1 illustrates a train and a switch locking system and method according to a preferred and non-limiting embodiment or aspect.

As disclosed herein, in a non-limiting embodiment or aspect, a system and method for controlling movement of a train in a track network may include a central train control network configured to transmit authority data associated with an issued movement authority for one or more locomotives to traverse a track network including a plurality of switches; a plurality of switch controllers associated, respectively, with each of the plurality of switches, the plurality of switch controllers adapted to interface with the central train control network and one or more on-board computers of one or more locomotives traversing the track network; and a locomotive including an on-board computer system, the on-board computer system configured to: receive authority data from the central train control network, the authority data associated with a movement authority to traverse a segment of the track network including a first switch of the plurality of switches; determine an approach by the locomotive to a geographic location of the first switch of the plurality of switches; and issue (e.g., authorize, communicate, transmit, send, etc.) a lock command by the on-board computer during the approach by the locomotive, the lock command issued directly to a first switch controller of the plurality of switch controllers to lock the first switch, wherein the first switch controller is configured to activate control of the first switch to lock out one or more remote switch control requests.

In this way, a switch locking system and method includes communicating and controlling a switch in the railway from a locomotive (e.g., a head of train computer, etc.) traversing one or more routes (e.g., authorized routes, planned routes, etc.) in the railway. Accordingly, the switch locking system and method of the present invention more accurately and/or efficiently controls a switch in the railway while traversing one or more routes. In some non-limiting embodiments or aspects, the switch locking method reduces or eliminates a processing delay and/or safety hazard associated with a switch by eliminating a hazard of moving a switch when the switch may not be moved (e.g., not alerting and/or not efficiently or accurately alerting an operator when a switch is positioned, etc.). Additionally, and/or alternatively, the switch locking system and method includes locking a switch (e.g., locking, unlocking, etc.) based on timely indications of operation data (e.g., on-board data about a head of a train and/or a rear of a train, etc.) to efficiently and/or safely traverse a switch. In addition, the switch locking system and method is capable and/or configured to efficiently and/or safely control and/or communicate a switch status (e.g., status of a switch, locked/unlocked information, etc.).

It is to be understood that the invention may assume various alternative variations and step sequences, except where expressly specified to the contrary. It is also to be understood that the specific products, systems, and processes illustrated in the attached drawings and described in the following specification are simply exemplary embodiments of the invention. Hence, specific dimensions and other physical characteristics related to the embodiments or aspects disclosed herein are not to be considered as limiting.

As used herein, the singular form of "a," "an," and "the" include plural referents unless the context clearly dictates otherwise.

As used herein, the terms "communication" and "communicate" refer to the receipt, transmission, or transfer of one or more signals, messages, commands, or other types of data. For one unit or device to be in communication with another unit or device means that the one unit or device is able to receive data from and/or transmit data to the other unit or device. A communication may use a direct or indirect connection and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, Global System for Mobile Communications (GSM), private wireless, public wireless, 160/220/900 MHz VHF, Wi-Fi, MiFi, WiMAX, Cellular 3G/4G/5G, Omni-directional, and/or the like.

Referring now to FIG. 1, FIG. 1 is a diagram of a non-limiting embodiment or aspect of a switch locking system 100 in which systems and/or methods, described herein, can be implemented. As shown in FIG. 1, in a non-limiting embodiment or aspect of switch locking system 100, train 10 includes a locomotive 12, one or more railcars 14, and an end of train railcar 16. Systems and/or devices of switch locking system 100 can interconnect via wired connections, wireless connections, or a combination of wired and wireless connections.

With continued reference to FIG. 1, as shown by reference number 120, a preferred and non-limiting embodiment or aspect of a switch locking system 100 may include an on-board computer 102 (e.g., on-board segment of a positive train control ("FTC") system, a locomotive control unit ("LCU"), head of train unit, etc.) located in or associated with the locomotive 12 of the train 10 communicates an information notification to a switch controller 104 for locking a switch 106.

In a non-limiting embodiment or aspect, the on-board computer 102 includes a display console (e.g., the train operator's console) in the locomotive. In a preferred and non-limiting embodiment or aspect, the on-board computer 102 may be connected to a switch controller 104 (e.g., an object controller, etc.) associated with (e.g., connected to, coupled to, etc.) a switch 106 in the railway. For example, on-board computer 102 sends a lock command to the switch controller 104 coupled to a switch 106 in the railway to control the switch 106 on approach.

In a non-limiting embodiment or aspect, the on-board computer 102 determines a locking distance 108 associated with sending a lock command to the switch controller 104 coupled to a switch 106. In some non-limiting embodiments or aspects, as the train 10 approaches the switch 106 the on-board computer 102 determines a locking distance 108 based on a distance to stop before reaching the switch 106. For example, the on-board computer 102 determines a locking distance 108 based on a distance to stop the train 10 before reaching the switch 106 (e.g., twice the braking distance, etc.).

In a non-limiting embodiment or aspect, the on-board computer 102 generates a lock command from a computer onboard the authorized locomotive to a switch controller 104 associated with the switch 106.

In a non-limiting embodiment or aspect, the on-board computer 102 issues a lock command from a computer onboard the authorized locomotive to a switch controller 104 associated with the switch 106.

In a non-limiting embodiment or aspect, the on-board computer 102 continuously updates the train operator with the status of operations of the train. In some non-limiting embodiments or aspects, if a potentially dangerous situation arises, such as reaching an unlocked switch, the on-board computer 102 communicates a warning (e.g., sends, displays a message, sounds an alarm, etc.) to a train operator that an emergency condition exists in the train. In some non-limiting embodiments or aspects, on-board computer 102 operates a braking application to slow the train.

In a non-limiting embodiment or aspect, the on-board computer 102 is equipped with a transceiver (e.g., combination transmitter and receiver, separate transceiver and receiver, etc.). In some non-limiting embodiments or aspects, an end of train ("EOT") device has an emergency brake valve that is controlled by its microprocessor unit, and the on-board computer 102 also includes an emergency toggle switch. In some non-limiting embodiments or aspects, by toggling this switch in an emergency, the train operator can cause the on-board computer 102 to transmit an emergency brake radio signal to an EOT device on train 10.

In a non-limiting embodiment or aspect, the on-board computer 102 has a primary display panel which features a dedicated display for each of the several types of the end of train railcar data. The end of train railcar data displayed includes brake pipe pressure, low battery condition, whether the railcar is stopped or in motion, and whether an emergency has been enabled or disabled. The on-board computer 102 also has a supplemental message display by which it visually conveys additional information such as, for example, data related to the status of the switch 106 and whether or not the switch controller 104 and on-board computer 102 are communicating properly.

In a non-limiting embodiment or aspect, a Service Interface Unit (SIU) provides the on-board computer 102 with the current brake pipe pressure. In some non-limiting embodiments or aspects, the on-board computer 102 automatically initiates a service brake application at the end of train railcar 16 simultaneously with the service reduction in brake pipe pressure initiated from the locomotive. For example, the on-board computer 102 in the locomotive 12 automatically transmits a service brake signal to an EOT device on train 10 when it obtains (e.g., reaches, traverses) a braking distance (e.g., a segment of track associated with a threshold distance, etc.) for a switch.

In a non-limiting embodiment or aspect, the on-board computer 102 may be located at any position or orientation on the train. In some non-limiting embodiments or aspects, the on-board computer 102 (e.g., on-board controller, on-board computer 102, train management computer, and/or the like) performs the calculations for the Positive Train Control (PTC) system and includes a communication device 110 and an on-board database 112 populated with data and/or which receives specified data and information from other trains, remote servers, back office servers, central dispatch, and/or the like, where this data may include track profile data, train data, information about switch locations, track heading changes (e.g., curves, and distance measurements), train consist information (e.g., the number of locomotives, the number of cars, the total length of the train, etc.), and/or the like. In some non-limiting embodiments or aspects, the on-board computer 102 includes PTC functions (e.g., train management, computer displays, cab signal monitors, brake and systems interfaces, an event recorder, etc.). In some non-limiting embodiments or aspects, an on-board computer 102 is connected to one or more other on-board computers by a wireless or wired connection.

In a non-limiting embodiment or aspect, the on-board computer 102 also includes or is in communication with the appropriate braking system and other software or programs to effectively implement the systems and methods according to the present invention. In one non-limiting embodiment or aspect, the on-board computer 102 receives real-time input from various locomotive control settings or components, including a positioning (e.g., navigation system, mapping system, etc.) system (e.g., a GPS receiver, at least one wheel tachometer/speed sensor, and/or the like). In some non-limiting embodiments or aspects, the on-board computer 102 includes or is in communication with a communication device 110 (e.g., a data radio, a communication interface, a communication component, and/or the like), which facilitates communication by or between locomotive 12 and/or the train 10 and some remote server or computer system (e.g., a central controller, a back office server, a remote server, central dispatch, back office PTC components, various wayside devices, such as signal or switch monitors, other on-board computers in the railway system, etc.). In some non-limiting embodiments or aspects, this communication may occur wirelessly or in a hard wired form (e.g., over the rails of the track, etc.). In addition, the on-board computer 102 includes or is in communication with a visual display device 114, such as the operator's display in the cab of the train 10.

In a non-limiting embodiment or aspect, visual display device 114 is used to present information and data to the operator of the train. In one non-limiting embodiment or aspect, the on-board database 112 includes information about switch locations, track heading changes (e.g., curves) and distance measurements, while the on-board computer 102 receives, from a remote computer (e.g., the back office server, etc.), train consist information (e.g., number of locomotives, cars, and total length of the train, etc.). In some non-limiting embodiments or aspects, the switch locking system and methods can be effectively implemented and used by, or on, train 10 having such an on-board computer 102 and associated components. Of course, it is envisioned that any type of train management system can be used within the context and scope of the present invention.

In some non-limiting embodiments or aspects, the on-board computer 102 sends its own identification and location information and/or identification and location information associated with the switch controller 104 to on-board computer 102.

In a non-limiting embodiment or aspect, the on-board computer 102 commands the train on approach to a switch 106 to apply brakes to slow down or stop to avoid entering an unlocked switch.

In a non-limiting embodiment or aspect, the on-board computer 102 receives updates from some remote server or computer system (e.g., a central controller, a back office server, a remote server, central dispatch, dispatching system, communications server, back office PTC components, various wayside devices, such as signal or switch monitors, other on-board computers in the railway system, etc.). For example, the on-board computer 102 receives updates from a back office (e.g., remote server, dispatcher, etc.) about trains operating on switch 106 (e.g., on the same track, a timely indication that the trains are approaching the switch 106, etc.).

In a non-limiting embodiment or aspect, the on-board database 112 may include a location associated with a location of the train on the railway. In some non-limiting embodiments or aspects, on-board computer 102 determines a position of the switch before sending a lock command. For example, on-board computer 102 determines a position and sends a lock command before the train arrives at the switch 106 (e.g., within a stopping distance of the switch, etc.). For example, the on-board computer 102 generates a stop target for the switch 106 and the train operator reduces the train speed (e.g., reduces to a stop, reduces for a visual confirmation, etc.) in response to the stop target based on a proximity to the switch and/or an issue with the switch (e.g., an unlocked switch, etc.).

In a non-limiting embodiment or aspect, the on-board computer 102 prevents a train from reaching the switch 106 based on the stop target for the switch. For example, in some non-limiting embodiments or aspects, the on-board computer 102 treats a switch as unlocked until it receives confirmation (e.g., it has confirmed) that the switch 106 is locked. In some non-limiting embodiments or aspects, switch controller 104 generates an acknowledgement that the switch 106 has been locked. In some non-limiting embodiments or aspects, switch controller 104 generates a response, including one or more communications (e.g., notifications, retries, etc.), for the acknowledgement. In some non-limiting embodiments or aspects, the on-board computer 102 generates a stop command for a switch. For example, the on-board computer 102 generates a stop command for a switch until a confirmation is received. In some non-limiting embodiments or aspects, the on-board computer 102 monitors the switch 106 until the switch 106 is unlocked (e.g., until the switch controller 104 receives confirmation that the switch is unlocked). In some non-limiting embodiments, the PTC system would intervene and bring the control system to a stop if not unlocked.

In a non-limiting embodiment or aspect, on-board computer 102 unlocks the switch 106 based on train information indicating an end of the train (e.g., determining a location of the end of the train).

In a non-limiting embodiment or aspect, the on-board computer 102 may not transmit, send, receive and/or obtain a notification (e.g., command, confirmation, notification, update, etc.) from a back office (e.g., remote server) about the switch 106. For example, in some non-limiting embodiments or aspects, the on-board computer 102 may not receive communications from a central dispatcher before locking and/or unlocking the switch 106. For example, the on-board computer 102 may determine a communication failure with a central computer (e.g., dispatcher, remote computer, etc.) before communicating a lock and/or unlock command to the switch 106.

In a non-limiting embodiment or aspect, the on-board computer 102 operates in coordination with a central dispatch computer. For example, the on-board computer 102 controls switch 106 remotely if there is no authority associated with the switch. For example, the on-board computer 102 controls switch 106 remotely after determining there is no authority associated with switch 106.

In a non-limiting embodiment or aspect, on-board computer 102 includes self-dispatching a switch to set any kind of route before determining an authority for the route. For example, to eliminate (e.g., reduce the need for, etc.) the switch state being controlled by the dispatcher, the process includes a user (e.g., crew, operator, engineer, etc.) controlling the switch state for self-dispatching within the constraints of the train's authority. For example, in some non-limiting embodiments or aspects, on-board computer 102 remotely controls the state of switch 106 while also operating from the locomotive to lock and/or unlock the switch 106. In some non-limiting embodiments or aspects, on-board computer 102 waits for a dispatcher to provide a communication (e.g., confirmation, authority, etc.) to proceed thorough the switch 106.

In a non-limiting embodiment or aspect, switch controller 104 sends information indicating a failure (e.g., communication failures, unequipped train, PTC system failures, etc.) to a remote system. For example, switch controller 104 sends information associated with the failure to a dispatcher. In some non-limiting embodiments or aspects, a remote computer (e.g., PTC, dispatcher, central computer) remotely locks a switch whenever an authority is issued when a train fails (e.g., an unequipped train, failed train, etc.). In some non-limiting embodiments or aspects, switch controller 104 unlocks the switch 106 after (e.g., only after authorized notification, etc.) confirmation a moving authority has been released (e.g., to prevent the potential for moving the switch while a train could be in proximity, etc.).

In some non-limiting embodiments or aspects, on-board computer 102 receives protection against routing hazards through at least one of: route locking, time and approach locking, and/or indication locking. In some non-limiting embodiments or aspects, a switch system includes a signal system to provide authority to the crew for approach to, and movement through, a switch using at least one of time and approach locking or indication locking to safely traverse the switch 106. For example, on-board computer 102 receives routing authorization including provisions for having adequate time for the train 10 to stop prior to reaching a misaligned switch. In some non-limiting embodiments or aspects, a form-based authority is used to govern movement to eliminate other types of locking by on-board computer 102 and/or a central computer includes a PTC system that can enforce limits of the movement authority and can enforce alignment of the switch. In some non-limiting embodiments or aspects, on-board computer 102 communicates, either directly or indirectly, with a central system for receiving, transmitting, or generating instructions for route locking to ensure a switch cannot change state while it is under the train or while it is within the braking distance of an approaching train.

In a non-limiting embodiment or aspect, the on-board computer 102 monitors the switch 106 to determine when to lock based on determining the actual distance between the train and the switch. In a non-limiting embodiment or aspect, the on-board computer 102 monitors the switch 106 on approach to determine when to lock based on determining the actual distance between the train and the switch.

In a non-limiting embodiment or aspect, the on-board computer 102 determines (e.g., calculates, etc.) both the actual distance between the train and the switch as well as the safe distance between the train and the switch. In some non-limiting embodiments or aspects, the on-board computer 102 commands the switch 106 to lock based on determining the actual distance between the train and the switch on approach.

In a non-limiting embodiment or aspect, the on-board computer 102 monitors the switch 106 on a leg of the switch to determine when to unlock the switch 106 based on determining the actual distance between the train and the switch. In some non-limiting embodiments or aspects, the on-board computer 102 monitors (e.g., monitors a signal from the switch 106, monitors a position of the switch 106, monitors a signal from the switch controller 104, etc.) the switch controller 104 as it moves away from the switch 106 on a leg of the switch (e.g., normal leg, reverse leg, etc.) to determine when to unlock the switch 106. In some non-limiting embodiments or aspects, the on-board computer 102 sends an unlock command to the switch controller 104 based on monitoring a switch controller 104 as it moves away from the switch 106 on a leg of the switch (e.g., normal leg, reverse leg, etc.) to determine when to unlock the switch 106.

In a non-limiting embodiment or aspect, the on-board computer 102 clears the lock status of the switch 106. In some non-limiting embodiments or aspects, the on-board computer 102 clears the lock status of the switch 106 based on the end of the train railcar 16 clearing a position associated with leaving the switch 106.

In a non-limiting embodiment or aspect, the on-board computer 102 receives the broadcast from the switch controller 104 and extracts the data from the message.

In a non-limiting embodiment or aspect, the on-board computer 102 sends its own identification and location information to the switch controller 104.

In a non-limiting embodiment or aspect, the on-board computer 102 reads switch data from switch controller 104 and, using the track location database, calculates both the actual distance between the train and switch, as well as the safe distance between the train 10 and the switch 106 to apply brakes to slow down or stop (if needed) to avoid a hazardous condition.

In a non-limiting embodiment or aspect, the switch locking system 100 determines a safe entry switch leg. For example, switch locking system 100 determines a status (e.g., locked, unlocked, unreported, unknown, etc.) associated with another train on the same track that is not being properly handled by the dispatcher.

In a non-limiting embodiment or aspect, the switch controller 104, after receiving a communication (e.g., message, command, notification, etc.), determines if it is a trusted communication (e.g., authenticates using a key exchange, authenticates using on-board keys, etc.). For example, in some non-limiting embodiments or aspects, any communication between the on-board computer 102 and the switch controller 104, includes validation of any message based on authentication (e.g., a security hash, on-board shared keys between on-board and the wayside computers). If someone tried to spoof the message, the wayside computer would be able to detect that it was coming from an unknown source and prevent it from being able to be changed.

In non-limiting embodiment or aspect, the switch controller 104 is programmed or configured to lock the switch (e.g., includes programming logic to lock the switch, includes programming logic to unlock the switch, includes programming logic to communicate a status of the switch, etc.). In some non-limiting embodiments or aspects, the switch controller 104 is programmed or configured to determine a track circuit associated with a switch and/or determine whether the train is approaching the switch 106 in the track circuit. In some non-limiting embodiments, the switch controller 104 is programmed or configured for determining a track circuit associated with a switch and determines whether the train is approaching the switch without confirming a train is in a track circuit associated with the switch.

In a non-limiting embodiment or aspect, switch controller 104 is programmed or configured to determine or communicate (e.g., report, send, etc.) a switch is locked or not locked based on a locomotive's direction (e.g., direction of a train, etc.).

In a non-limiting embodiment or aspect, the switch controller 104, after determining a communication is trusted, determines an action associated with the communication (e.g., determines what to do, etc.). For example, the switch controller 104 locks the switch if the trusted communication requests to lock the switch and/or unlocks the switch if the trusted communication requests to unlock the switch.

In a non-limiting embodiment or aspect, the switch controller 104, broadcasts its identification number and location information (e.g., latitude, longitude, speed, heading, location uncertainty, etc.). In some non-limiting embodiments or aspects, the switch controller 104 broadcasts its identification number and location information to the on-board computer 102 and the train heading into the railway receives the broadcast.

In a non-limiting embodiment or aspect, the switch controller 104 is configured to pass messages to on-board computer 102 having the entire database of any switch. In a non-limiting embodiment or aspect, the on-board computer 102 cross-references the on-board database 112 to find out how to proceed when a train is running too close, or too fast, in an approach to switch 106.

In a non-limiting embodiment or aspect, the switch controller 104 receives the lock command (e.g., via a message, broadcast, etc.) from the on-board computer 102 and it obtains (e.g., extracts, retrieves) the data from the message. For example, the switch controller 104 receives switch data associated with the lock command from the on-board computer 102 when it receives a command (e.g., the lock command, the unlock command, a status request, etc.).

In a non-limiting embodiment or aspect, switch controller 104 receives track data associated with the track location from on-board database 112. For example, in some non-limiting embodiments or aspects, switch controller 104 calculates both the actual distance between the train 10 and switch 106 as well as the safe distance between the train 10 and the switch 106 to apply brakes to slow down or stop (e.g., if determined necessary, etc.) to avoid a hazardous condition in the railway.

Figure 2:
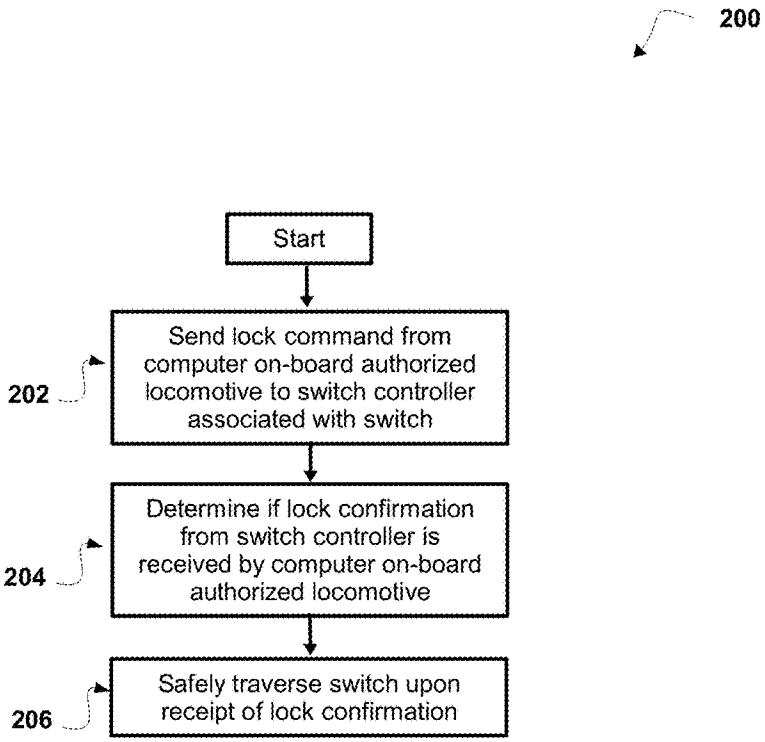
FIG. 2 illustrates a flowchart of a non-limiting embodiment of a process for switch locking according to a preferred and non-limiting embodiment or aspect.

Referring now to FIG. 2, FIG. 2 is a flowchart of a non-limiting embodiment or aspect of a process 200 of switch locking from an authorized locomotive for safely traversing a switch in a railway. In some non-limiting embodiments or aspects, one or more of the steps of process 200 are performed (e.g., completely, partially, etc.) in a railway system including on-board computer 102 and/or switch controller 104, and switch 106. In some non-limiting embodiments or aspects, one or more of the steps of process 200 are performed (e.g., completely, partially, etc.) by another device or a group of devices separate from or including on-board computer 102 (e.g., one or more devices of an on-board computer 102).

As shown in FIG. 2, at step 202, process 200 includes sending a lock command from a computer onboard an authorized locomotive to a switch controller 104 associated with a switch 106. For example, in some non-limiting embodiments or aspects, the on-board computer 102 sends a lock command from a computer onboard the authorized locomotive to a switch controller 104 associated with the switch 106.

In a non-limiting embodiment or aspect, the on-board computer 102 determines the locomotive 12 of train 10 is an authorized locomotive traversing an approach to a geographic location associated with the switch. For example, in some non-limiting embodiments or aspects, the on-board computer 102 determines the authorized locomotive is traversing a track within a distance (e.g., threshold, stopping distance, warning distance, predetermined distance, etc.) of a geographic location associated with the switch.

In a non-limiting embodiment or aspect, the on-board computer 102 determines an acceptable (e.g., updated switch alignment, etc.) for the authorized locomotive to traverse a segment of the railway associated with a switch leg of the switch 106. In some non-limiting embodiments or aspects, the on-board computer 102 sends a switch command to switch controller 104 based on an acceptable switch alignment for the authorized locomotive to traverse a segment of the railway associated with a switch leg.

In a non-limiting embodiment or aspect, on-board computer 102 issues a switch command by the computer onboard the authorized locomotive, the switch command issued to the switch controller to align (e.g., position, move, orient, configure, etc.) the switch to the acceptable switch alignment.

In a non-limiting embodiment or aspect, on-board computer 102 controls the switch 106 by the switch controller 104 to align the switch 106 in accordance with the switch command. For example, on-board computer 102 sends a switch command to control the switch 106 by the switch controller 104 to align the switch 106 in accordance with the switch command.

In a non-limiting embodiment or aspect, on-board computer 102 sends a command (e.g., lock command, unlock command, information request, etc.) to a switch controller 104 associated with the on-board computer 102 for determining an address of the switch controller 104 of the switch 106. In some non-limiting embodiments or aspects, on-board computer 102 sends a command (e.g., lock command, request, etc.) to a switch controller 104 associated with the switch 106 based on an address of the switch controller 104 of the switch 106.

In a non-limiting embodiment or aspect, switch controller 104 receives a request by at least one of a second locomotive or a central dispatcher to control the switch 106.

In a non-limiting embodiment or aspect, in response to receiving a request by at least one of a second locomotive or a central dispatcher to control the switch 106, switch controller 104 generates a switch status indicating that the switch is locked to indicate a train is traversing a segment of the railway including the at least one portion of the switch.

In a non-limiting embodiment or aspect, in response to receiving a request by at least one of a second locomotive or a central dispatcher to control the switch 106 while it is locked by on-board computer 102, switch controller 104 transmits the switch status to at least one of a second locomotive (e.g., a train on the same railway, etc.) or a central dispatcher. In some non-limiting embodiments or aspects, in response to receiving a request by at least one of a second locomotive or a central dispatcher to control the switch 106 while it is locked by on-board computer 102, switch controller 104 transmits information (e.g., latitude, longitude, speed, heading, location uncertainty, etc.) associated with one of a second locomotive (e.g., a train on the same railway, etc.) to a central dispatcher or the locking locomotive (e.g., locomotive issuing the command, etc.).

As shown in FIG. 2, at step 204, process 200 includes determining if a lock confirmation from a switch controller 104 is received by computer onboard the authorized locomotive. For example, in some non-limiting embodiments or aspects, the on-board computer 102 is configured to determine if a lock confirmation from the switch controller 104 is received by the authorized locomotive.

In a non-limiting embodiment or aspect, on-board computer 102 prevents the authorized locomotive from traversing the switch if the lock confirmation from the switch controller 104 is not received by the computer onboard the authorized locomotive.

In a non-limiting embodiment or aspect, on-board computer 102 prevents an external lock command from a switch dispatcher to influence position of the switch 106 until the authorized locomotive has safely traversed and/or unlocked the switch 106.

In a non-limiting embodiment or aspect, on-board computer 102 transmits a confirmation to the computer onboard the authorized locomotive or a dispatch computer, the confirmation including a switch status indicating the switch 106 is locked.

As shown in FIG. 2, at step 206, process 200 includes safely traversing the switch upon receipt of a lock confirmation. For example, in some non-limiting embodiments or aspects, the on-board computer 102 and/or the switch controller 104 are configured to directly and/or indirectly control the train 10 to safely traverse the switch 106 upon receipt of a lock confirmation.

In a non-limiting embodiment or aspect, on-board computer 102 issues an unlock command to the switch 106. For example, on-board computer 102 generates and sends an unlock command to the switch 106 as it clears a threshold distance associated with exiting a switch (e.g., a track segment associated with the switch, etc.).

In a non-limiting embodiment or aspect, on-board computer 102 controls the switch 106 by the switch controller 104 to release the switch 106 from a locked status based on receiving an unlock command to the switch 106. For example, switch controller 104 updates the status of the lock to unlock the switch 106 based upon on-board computer 102 issuing an unlock command to the switch 106.

In a non-limiting embodiment or aspect, on-board computer 102 controls the switch 106 by using the switch controller 104 to release the switch from a locked status.

In a non-limiting embodiment or aspect, switch controller 104 controls the switch by releasing the switch 106 from a locked status.

In a non-limiting embodiment or aspect, on-board computer 102 controls the switch 106 (e.g., locking, unlocking, etc.) based on leaving an authority for the route. For example, in some non-limiting embodiments or aspects, on-board computer 102 remotely controls the switch 106 by commanding switch controller 104 to unlock the switch 106. In some non-limiting embodiments or aspects, on-board computer 102 updates a dispatcher via a communication after unlocking the switch 106 (e.g., sends a message when clearing the switch, etc.).

In a non-limiting embodiment or aspect, the on-board computer 102 monitors the switch 106 to determine when to unlock the switch 106. For example, the on-board computer 102 monitors the switch 106 based on a distance between the train 10 and the switch 106. In a non-limiting embodiment or aspect, the on-board computer 102 monitors the switch 106 as it exits the switch 106 (e.g., clears the area associated with the switch, etc.) to determine when to unlock. For example, the on-board computer 102 monitors the switch 106 as it exits the switch 106 (e.g., clears the area associated with the switch, etc.) to determine when the train (e.g., an end of the train railcar 16, etc.) has cleared a threshold distance associated with the switch 106.

Figure 3A:
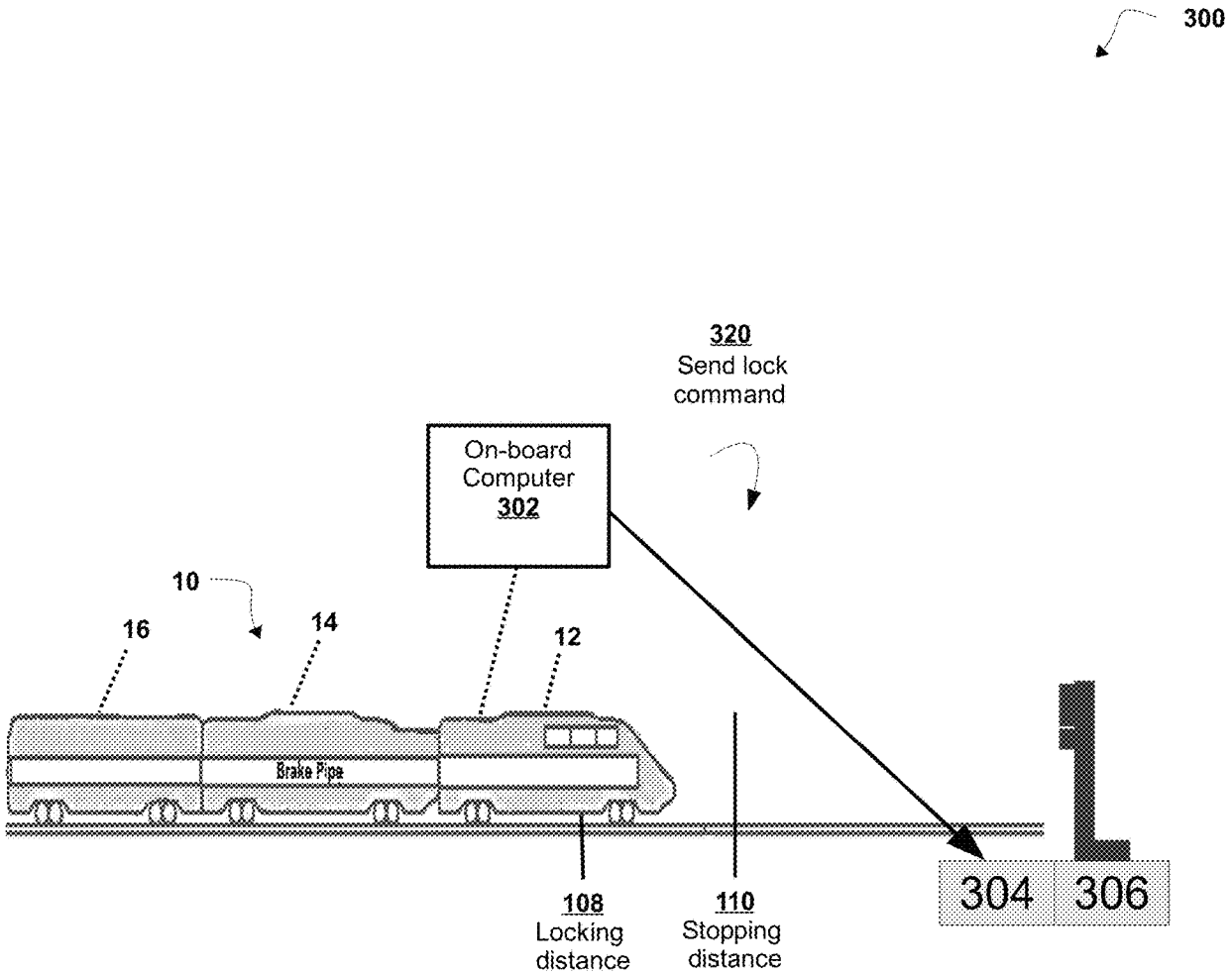
FIGS. 3A-3C illustrate an implementation of a non-limiting embodiment of a process for switch locking, confirmation, and unlocking as disclosed herein according to a preferred and non-limiting embodiment or aspect.
Figure 3B:
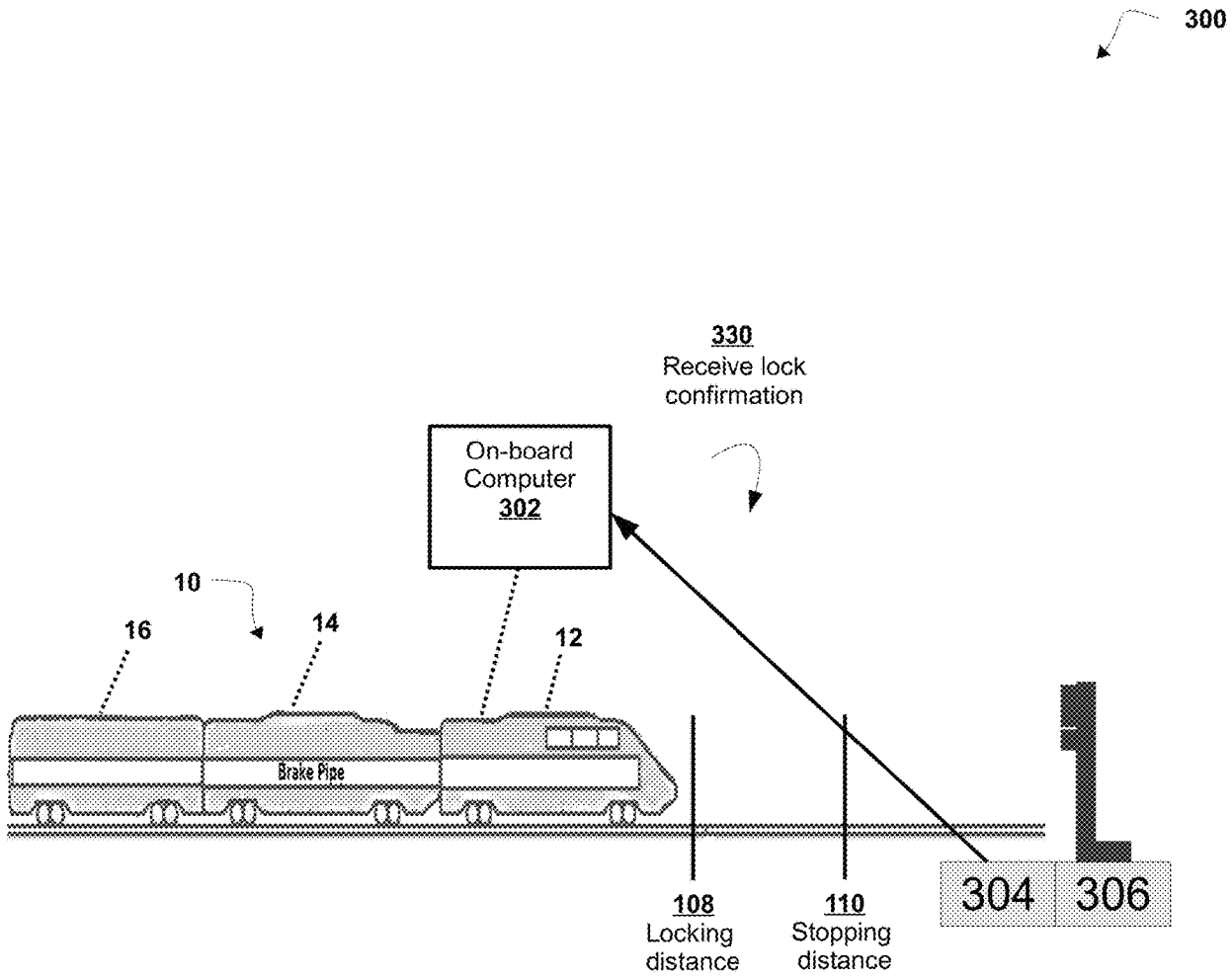
Figure 3C:
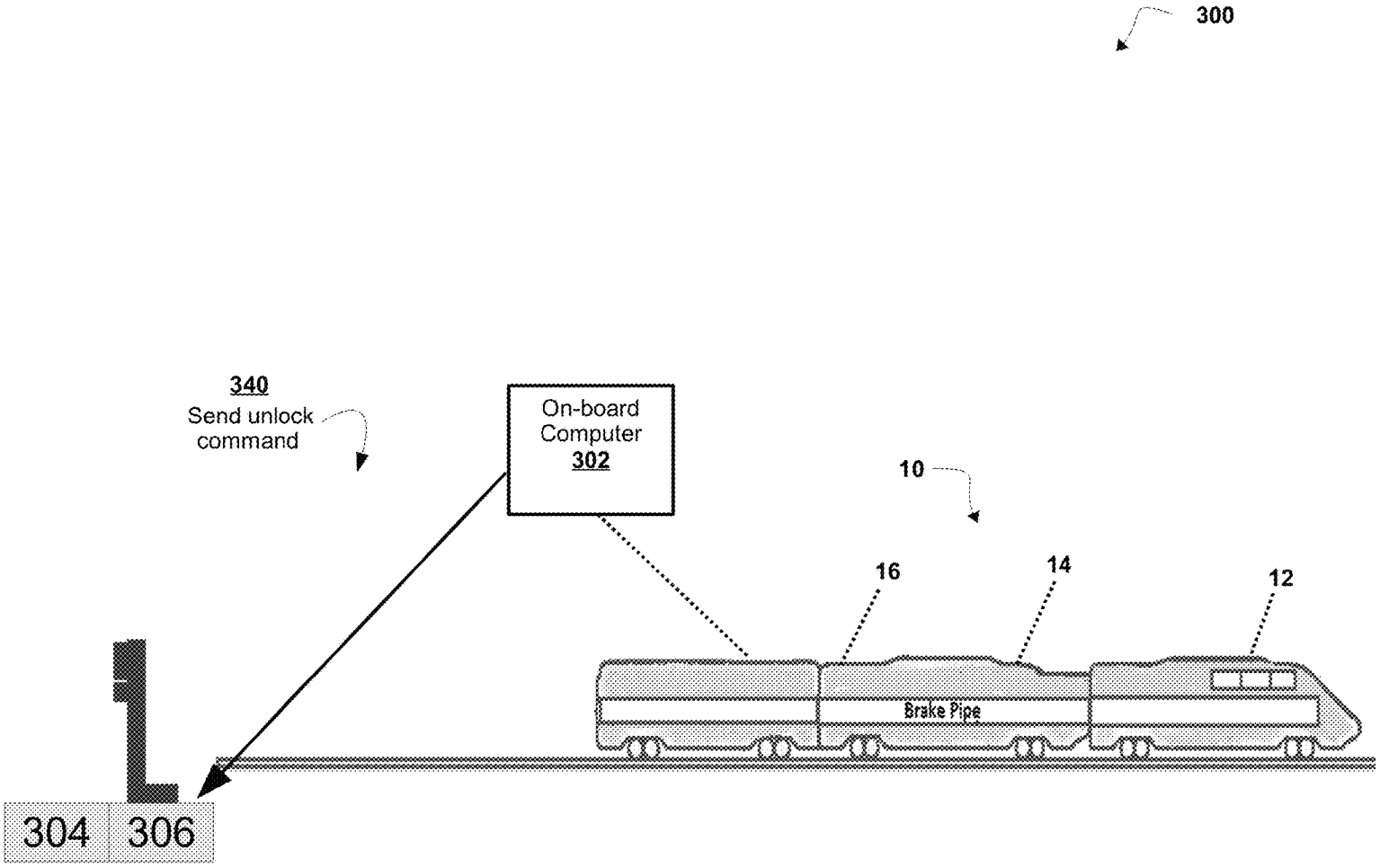

Referring now to FIGS. 3A-3C, FIGS. 3A-3C are diagrams of an overview of a non-limiting embodiment or aspect of an implementation 300 relating to a switch locking method. As shown in FIGS. 3A-3C, implementation 300 may include a train 10, an on-board computer 302, a switch controller 304, and a switch 306. In some non-limiting embodiments or aspects, on-board computer 302 and switch controller 304 may be the same or similar to on-board computer 102 and switch controller 104, respectively.

As shown by reference number 320 in FIG. 3A, implementation 300 includes sending a lock command to switch 306 from an on-board computer 302 of the train 10. For example, in some non-limiting embodiments or aspects, on-board computer 302 of train 10 includes a PTC system in the active state. For example, on-board computer 302 receives (e.g., has received, etc.) authority to proceed through switch controller 304 on the route ahead.

In a non-limiting embodiment or aspect, train 10 approaches the switch to within a range of the switch (e.g., enters an approach, enters a segment of railway associated with a switch, enters an area of the railway associated with a switch warning, for example, twice the braking distance from the switch, etc.). In some non-limiting embodiments or aspects, on-board computer 302 sends a lock command to the switch 306 (e.g., switch controller 304 associated with the switch, object controller associated with the switch, etc.).

As shown by reference number 330 in FIG. 3B, implementation 300 includes receiving a locking confirmation. For example, in some non-limiting embodiments or aspects, on-board computer 302 receives a locking confirmation from switch 306 (e.g., switch controller 304, etc.). In some non-limiting embodiments or aspects, on-board computer 302 receives a locking confirmation after the switch controller 304 associated with switch 306 receives a lock command, issues a lock command to the switch 306, and/or performs an action on the switch 306 to lock out any remote switch control requests. In some non-limiting embodiments or aspects, switch controller 304 associated with switch 306 reports to the on-board computer 302 (e.g., on-board PTC system of the locomotive, etc.) a status of the switch (e.g., switch is locked, unlocked, etc.). In some non-limiting embodiments or aspects, the on-board computer 302 (e.g., on-board PTC system, etc.) determines (e.g., enforces, completes, etc.) a stop at the switch 306 if there is no confirmation of the locked status. In some non-limiting embodiments or aspects, the on-board computer 302 (e.g., on-board PTC system, etc.) determines (e.g., enforces, completes, etc.) to allow (e.g., authorize, etc.) the train to proceed if the lock is confirmed.

As shown by reference number 340 in FIG. 3C, implementation 300 includes sending an unlock command. For example, in some non-limiting embodiments or aspects, on-board computer 302 sends an unlock command to switch controller 304. For example, on-board computer 302 sends an unlock command directly to switch controller 304 for unlocking switch 306. In some non-limiting embodiments or aspects, on-board computer 302 sends an unlock command directly to switch controller 304 after the end of the train railcar 16 is clear of the switch. In some non-limiting embodiments or aspects, on-board computer 302 (e.g., on-board PTC, etc.) sends an unlock command directly to switch controller 304 and then releases the locked state of the switch 306.

In a non-limiting embodiment or aspect, the switch locking system and method may further include a computer application, such as a smart phone application, through which users may receive push notifications. By way of a non-limiting embodiment or aspect, the push notifications may depend on the role of the users, such as whether the users are associated with the railroad for the train 10 or is associated with another specified entity, such as a first responder.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the description. For example, it is to be understood that the present invention contemplates that, to the extent possible, one or more features of any embodiment can be combined with one or more features of any other embodiment.

What is claimed is:

1. A method comprising:

sending a lock command from a computer onboard a locomotive to a switch controller associated a the switch in a railway;

determining whether a lock confirmation from the switch controller is received by the computer onboard the locomotive; and traversing the switch in response to receiving the lock confirmation from the switch controller.

2. The method of claim 1, further comprising:

preventing the locomotive from traversing the switch responsive to the lock confirmation not being received by the computer onboard the locomotive from the switch controller.

3. The method of claim 1, further comprising:

preventing an external command from a switch dispatcher to change a position of the switch until the locomotive has unlocked the switch.

4. The method of claim 1, further comprising:

determining an acceptable switch alignment for the locomotive to traverse a segment of the railway associated with a switch leg;

issuing a switch command by the computer onboard the locomotive, the switch command issued to the switch controller to align the switch to the acceptable switch alignment; and controlling the switch by the switch controller to align the switch in accordance with the switch command.

5. The method of claim 1, further comprising:

transmitting the lock confirmation to the computer onboard the locomotive or a dispatch computer, the lock confirmation including a switch status indicating the switch is locked.

6. The method of claim 1, further comprising:

communicating an unlock command from the computer onboard the locomotive to the switch controller.

7. The method of claim 1, wherein sending the lock command further comprises:

determining an address of the switch controller of the switch; and transmitting the lock command to the switch via the switch controller based on the address of the switch controller of the switch.

8. A method comprising:

determining approach of a self-dispatching locomotive toward at least one switch located on a railway;

issuing a lock command by the self-dispatching locomotive, the lock command issued to a switch controller associated with the at least one switch to lock the at least one switch; and determining whether a signal is received by the self-dispatching locomotive from the switch controller; and moving through the at least one switch responsive to the lock command being issued to the switch controller.

9. The method of claim 8, further comprising:

determining whether the signal from the switch controller indicates a lock confirmation of the at least one switch; and preventing the self-dispatching locomotive from traversing the at least one switch responsive to the signal not including the lock confirmation or the signal not being received by the self-dispatching locomotive.

10. The method of claim 8, comprising:

preventing external commands from a central dispatcher to change a position of the at least one switch until the self-dispatching locomotive has unlocked the at least one switch.

11. The method of claim 8, further comprising:

determining an acceptable switch alignment of the at least one switch for the self-dispatching locomotive to traverse a segment of the railway associated with a switch leg; and issuing a switch command from the self-dispatching locomotive to align the at least one switch to the acceptable switch alignment.

12. The method of claim 8, further comprising:

wherein the signal is received by the self-dispatching locomotive and includes a lock confirmation indicating that the at least one switch is locked.

13. The method of claim 8, further comprising:

determining clearance of the at least one switch by the self-dispatching locomotive; and issuing an unlock command from the self-dispatching locomotive to the at least one switch to unlock the at least one switch in response to determining clearance of the at least one switch by the self-dispatching locomotive.

14. The method of claim 8, wherein issuing the lock command by the self-dispatching locomotive further comprises:

determining an address for the switch controller of the at least one switch; and transmitting the lock command to the switch controller based on the address for the switch controller.

15. A system comprising:

an on-board computer system configured to be onboard a locomotive, the computer system configured to determine approach of the locomotive toward a switch in a railway and to send a lock command to a switch controller associated with the switch, the computer system configured to determine whether a lock confirmation is received from the switch controller and to allow the locomotive to traverse the switch upon receipt of the lock confirmation.

16. The system of claim 15, wherein the computer system is further configured to determine an acceptable switch alignment of the switch to traverse a segment of the railway associated with a switch leg and issue a switch command to align the switch to the acceptable switch alignment.

17. The system of claim 16, wherein the computer system is configured to send an unlock command to the switch controller to unlock the switch.

18. The method of claim 1, wherein the switch is a first switch and the switch controller is a first switch controller, and further comprising:

receiving a signal at the computer onboard the locomotive from a second switch controller associated with a second switch, the signal indicating that the second switch is unlocked; and automatically braking the locomotive responsive to the computer onboard the locomotive receiving the signal from the second switch controller before the locomotive reaches the second switch.

19. The method of claim 8, further comprising:

determining whether the signal received from the switch controller indicates that the at least one switch is unlocked; and automatically stopping movement of the self-dispatching locomotive responsive to determining that the at least one switch is unlocked.

20. The system of claim 15, wherein the computer system is configured to automatically slow or stop movement of the locomotive responsive to not receiving the lock confirmation from the switch controller or receiving a signal from the switch controller that indicates the switch is unlocked.

* * * * *